US006213114B1

(12) United States Patent
Burkhart

(10) Patent No.: US 6,213,114 B1
(45) Date of Patent: Apr. 10, 2001

(54) DISENGAGEABLE NOCK FOR ARROWS

(76) Inventor: Christopher L. Burkhart, 1418 E. Marconi Ave., Phoenix, AZ (US) 85022-3226

( * ) Notice: Subject to any disclaimer, the term of this patent is extended or adjusted under 35 U.S.C. 154(b) by 0 days.

(21) Appl. No.: 09/550,677

(22) Filed: Apr. 17, 2000

(51) Int. Cl.[7] ..... F41B 5/14; F42B 6/06
(52) U.S. Cl. ..... 124/91
(58) Field of Search ..... 124/91; 473/578

(56) References Cited

U.S. PATENT DOCUMENTS

| | | | | |
|---|---|---|---|---|
| 1,785,589 | * | 12/1930 | Mead . | |
| 2,905,166 | * | 9/1959 | Niemeyer . | |
| 3,010,446 | * | 11/1961 | Frantello . | |
| 5,361,747 | | 11/1994 | Laabs | 124/91 |
| 5,919,105 | * | 7/1999 | Summers | 473/578 |

OTHER PUBLICATIONS

Publication entitled "Archer's Digest, 6$^{TH}$ Edition", by Combs, Roger, 1995, pp. 48–52, 121–124, 125–129, and 134–138.

* cited by examiner

*Primary Examiner*—John A. Ricci
(74) *Attorney, Agent, or Firm*—Cahill, Sutton & Thomas P.L.C.

(57) ABSTRACT

A nock for use with an arrow includes a receiver having a bowstring engaging notch with a pin extending thereacross to capture and retain the bowstring within the notch and an insert permanently attached to an arrow shaft for disengageably engaging the receiver. A retention device, such as a magnet attached to the receiver, magnetically cooperating with a magnetically responsive member attached to the insert, retains the arrow shaft in engagement with the bowstring as the bowstring is pulled back. Upon release of the bowstring, the forward momentum of the arrow overcomes the retention force of the retention device and the arrow shaft disengages from the receiver to begin its flight.

21 Claims, 3 Drawing Sheets

DISENGAGEABLE NOCK FOR ARROWS

BACKGROUND OF THE INVENTION

1. Field of the Invention

The present invention relates to archery equipment and, more particularly, to nocks for use with arrows.

2. Description of Related Art

In the field of modem archery, the rear end of an arrow includes a notch for receiving the bowstring. Usually, the notch is defined by a permanently attached nock. The nock includes a hollow end for receiving the end of the arrow shaft. If the shaft is tubular, the nock may include a stud for insertion into the shaft. Other variants for attaching the nock to the shaft exist.

The notch of the nock is formed by a pair of rearwardly extending wings for receiving the bowstring therebetween. These wings usually include opposed inwardly extending protrusions for gripping the bowstring as the bowstring is drawn back and released, whether by one's fingers or by a mechanical triggering element. Generally, the bowstring includes a nocking point formed by dental floss, light thread, or yarn wrapped around the bowstring. Various commercially available sleeves may be attached about the bowstring to serve as a nocking point.

Since the bowstring is drawn back by engaging the bowstring itself, not the arrow, there is some danger of the arrow shaft disengaging from the bowstring unless the nock firmly grips the bowstring. Such gripping is provided by the protrusions discussed above. Upon release of the bowstring, the arrow accelerates rapidly in the direction of flight. The resulting momentum of the arrow causes the nock to release from the bowstring at the end of forward travel of the bowstring. The resulting resistance to forward movement of the arrow caused by the arrow overcoming the clamping action of the nock to effect release of the arrow decelerates the arrow to an extent which is a function of the gripping force exerted by the nock. Such deceleration negatively affects the speed of the arrow and hence distance traveled. Moreover, the sudden deceleration may set up a quiver or vibration of the arrow shaft along its length which affects its aerodynamic properties, and increases air resistance. The vibrating arrow shaft may also affect the accuracy of its expected trajectory. By reducing the clamping force of the nock, inadvertent disengagement of the nock from the bowstring is to be expected under field conditions. Such disengagement is unacceptable in a hunting environment. This result may even cause a life-threatening situation if the animal being hunted is prone to attack the archer.

SUMMARY OF THE INVENTION

The present invention is a two-part nock having an insert permanently attached to the rear end of the shaft of an arrow and a receiver retained by a bowstring and disengageably engageable with the insert. The receiver includes a notch for receiving the bowstring and a pin extending across the notch for precluding disengagement of the bowstring from the notch. A cavity in the receiver slidably receives the insert in a predetermined aligned manner to ensure proper orientation of the fletching or feathers of the arrow. The insert is retained with the receiver by use of a magnet, hook and loop fastening means, or other disengageable engaging means. The retention force between the insert and the receiver is sufficient to preclude disengagement of the arrow as the bowstring is pulled back under field conditions and yet the force required to release the arrow at the end of travel of the bowstring is minimal and has little negative effect upon the flight path of the arrow.

It is therefore a primary object of the present invention to provide a two-part nock for easily disengaging an arrow from a bowstring.

Another object of the present invention is to provide a two-part nock having a receiver retained on a bowstring and a shaft mounted insert disengageably engageable with the receiver.

Still another object of the present invention is to provide a two-part nock using a magnetic force to retain the parts engaged and yet permit disengagement.

Yet another object of the present invention is to provide a nock attached to a bowstring for disengageably engaging the end of the shaft of an arrow in predetermined alignment.

A further object of the present invention is to provide a nock attached to a bowstring at a predetermined location for engaging the end of an arrow shaft in predetermined alignment.

A still further object of the present invention is to provide a nock having an insert permanently attached to the end of an arrow shaft for disengageable engagement with a receiver secured to a bowstring.

A yet further object of the present invention is to provide a method for releasably securing an arrow shaft with a nock attached to a bowstring.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
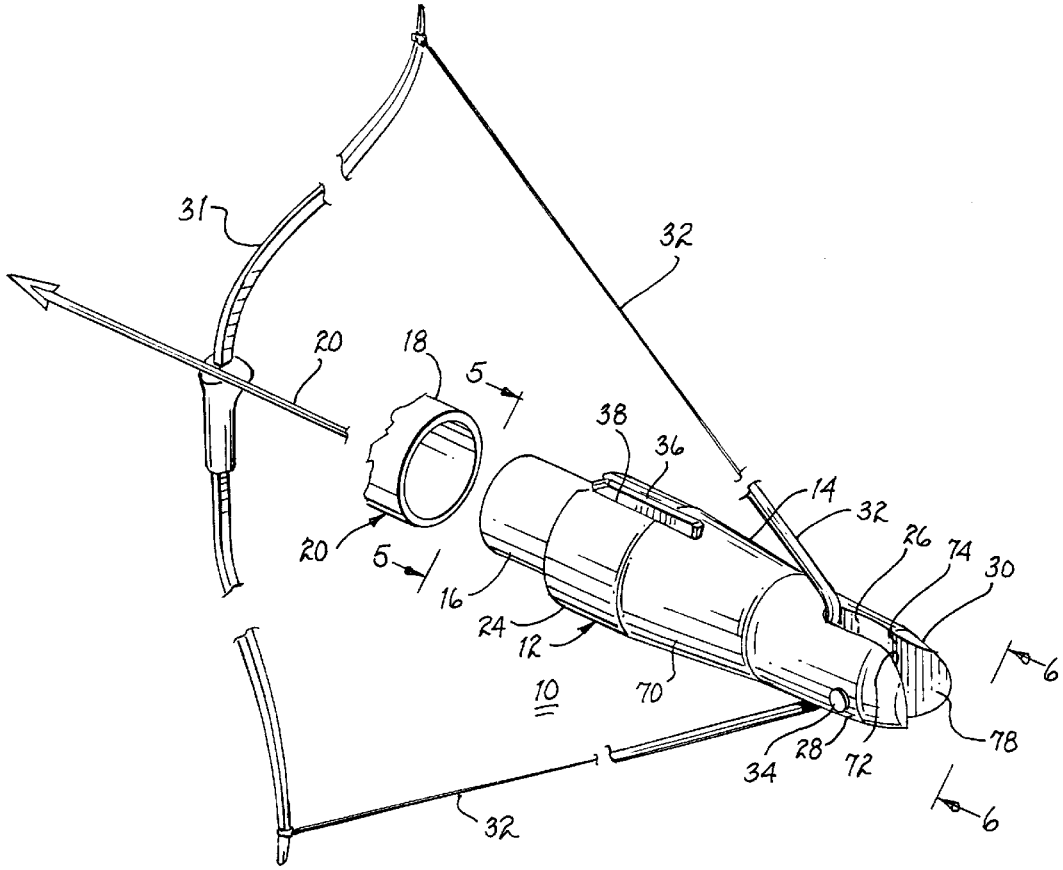
FIG. 1 illustrates an assembled two-part nock and a partial view of a bow and arrow.
Figure 2:
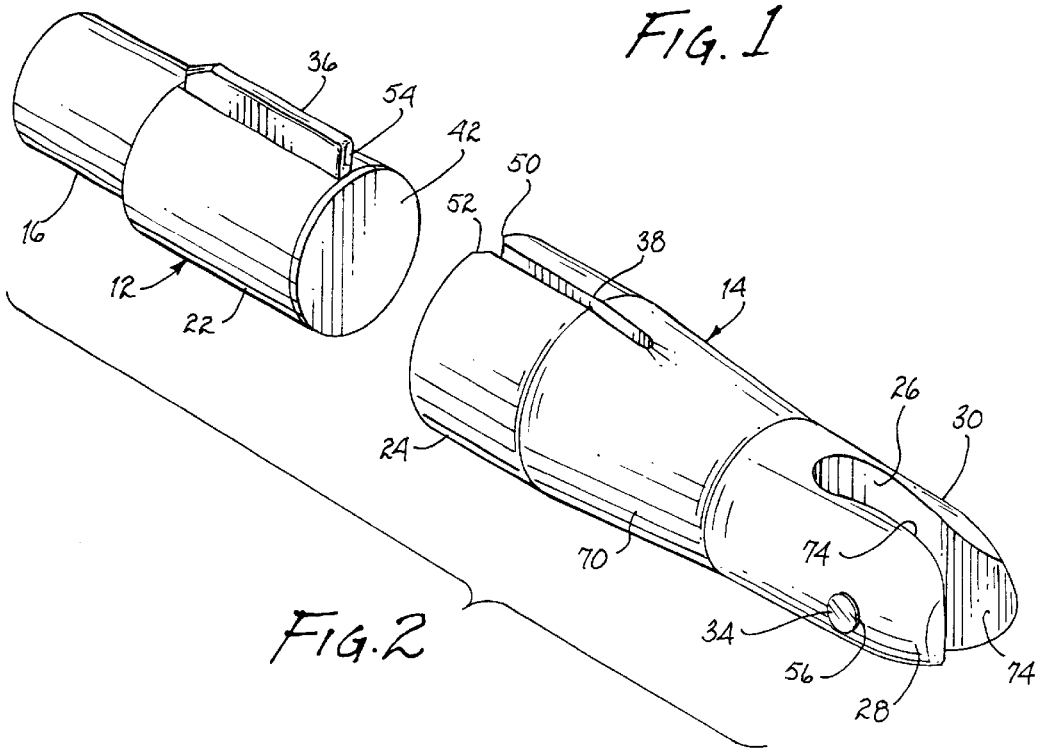
FIG. 2 illustrates the insert and receiver of a two-part nock.

Referring jointly to FIGS. 1 and 2, there is shown a two-part nock 10 having an insert 12 and a receiver 14. Reduced diameter stud 16 of insert 12 fits within and is secured to the rear end of hollow shaft 18 of an arrow 20. The attachment between the stud and the shaft may be secured by use of an adhesive, press fit, or the like, for a permanent engagement. A base 22 of insert 12 slidably fits within a sleeve 24 of receiver 12. A notch 26 is formed in receiver 14 by a pair of wings 28,30. A bowstring 32 is seated within notch 26 and is prevented from disengagement with receiver 14 of nock 10 by a pin 34 secured in wings 28,30 and extending across the notch. Axial orientation of arrow 20 relative to the bow and bowstring is important to ensure that the fletchings, or feathers, of the arrow are correctly oriented with respect to the bow and with respect to any attachments to the bow in proximity of the arrow as the arrow is discharged therepast. Such orientation is achieved by ridge 36 extending radially from insert 12 into engagement with a slot 38 formed in sleeve 24 of receiver 14.

Figure 3:
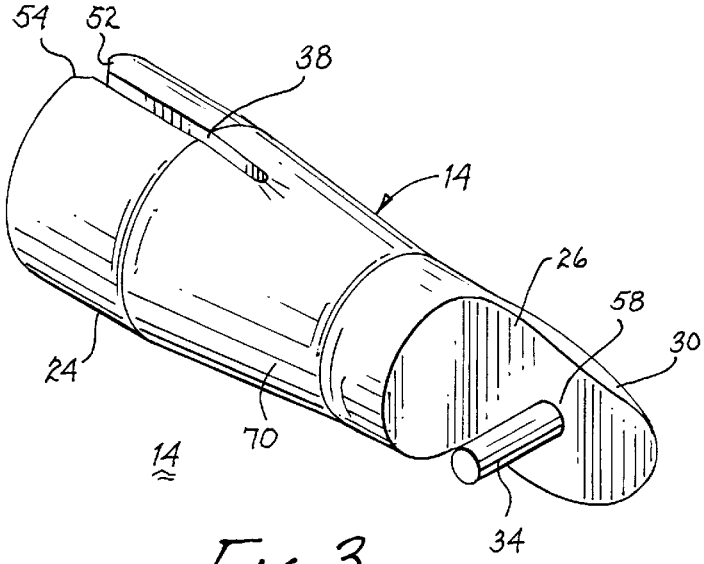
FIG. 3 illustrates a partial view of the bowstring retention element of the receiver.
Figure 4:
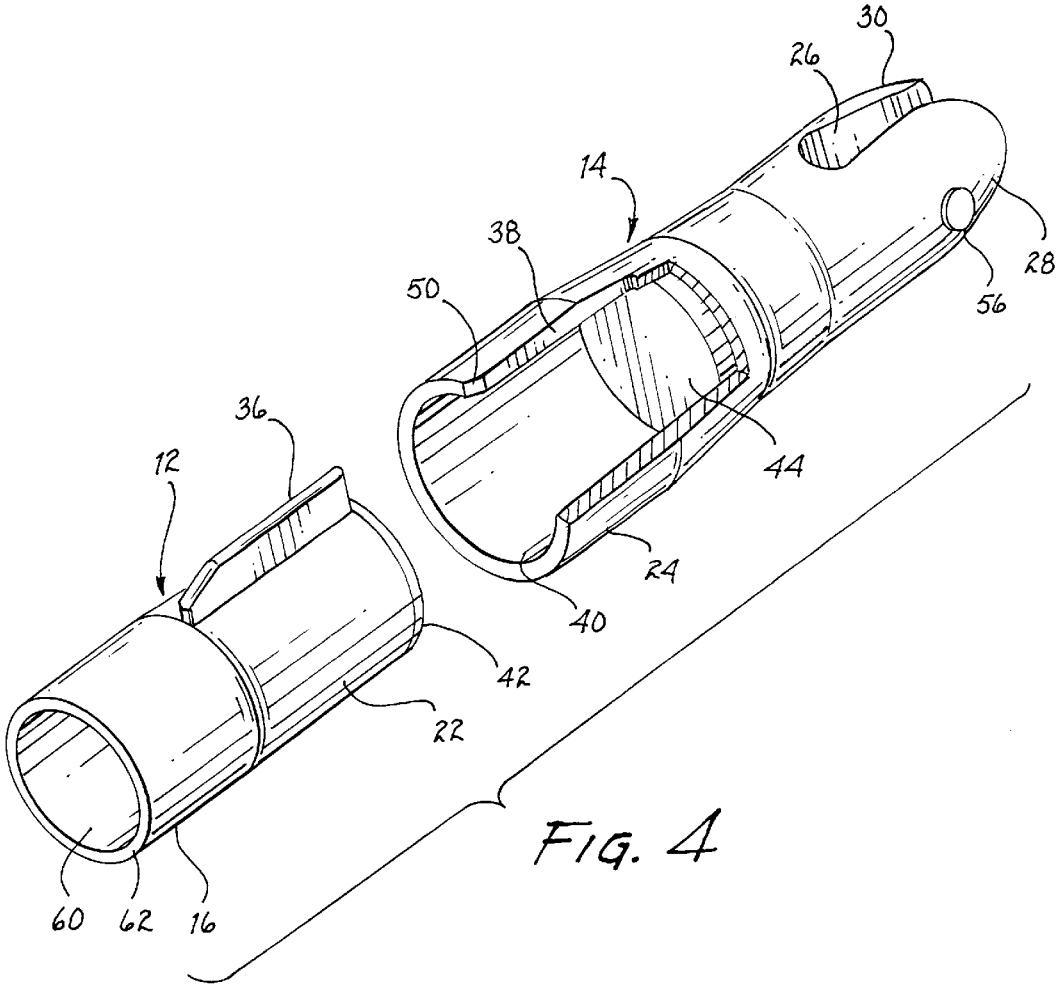
FIG. 4 illustrates a magnet for disengageably engaging the insert with the receiver.

Referring jointly to FIGS. 2, 3, and 4, further details of nock 10 will be described. Sleeve 24 of receiver 14 includes a cylindrical cavity 40 for receiving base 22 of insert 12. The end of the base includes an iron, steel, or other magnetically responsive plate 42. As shown in the partial cutaway view in FIG. 4 of sleeve 24, a magnet 44 is disposed at the end of cylindrical cavity 40 in receiver 14. Upon insertion of base 22 into the cylindrical cavity, the force of magnet 44 acting upon plate 42 will retain insert 12 in engagement with receiver 14. Upon exertion of an axially oriented force upon insert 12 away from receiver 14, such as the momentum of the arrow leaving the bowstring, the magnetic force between magnet 44 and plate 42 will be overcome and separation between the insert and the receiver of the nock will occur. It is to be understood that the locations of the magnet and plate may be reversed and that other disengageable/engageable means such as a pair of magnets to increase the magnetic force, the hook and loop type fastener sold under the trademark Velcro™, a reuseable mastic, ball and releaseable socket, or other chemical or mechanical elements permitting engagement and disengagement upon application of appropriate forces, are also useable.

To assist bringing about engagement of the insert with the receiver to secure an arrow to the bowstring, entrance to slot 38 may be chamferred by chamfers 50,52 to guide ridge 36 into the slot. Similarly, proximal end 54 of ridge 36 may be tapered or rounded (as shown) to facilitate insertion of the ridge into slot 38.

Retaining pin 34 discussed with respect to FIG. 1 is shown in further detail in FIG. 3. While pin 34 may be removable to permit insertion of bowstring 32 into notch 26, such removal should be only on an occasional basis. Receiver 14 is intended to remain affixed to the bowstring during a hunting or other archery related event. It is therefore contemplated that the pin may be a press fit into corresponding aperture 56 of wing 28 and aperture 58 of wing 30. By using a press fit, the pin is removable when necessary and yet will be retained in place during normal use of the bow. Other retention means, such as a threaded engagement, can be used.

Referring particularly to FIG. 4, there is shown a variant configuration of insert 12. In this variant, a cylindrical cavity 60 for receiving a necked down section of an arrow shaft is used instead of stud 16. Alternatively, if ridge 62, defining the cavity, will not interfere with the bow or arrow support/guidance devices on the bow, the end of the shaft, without a necked down section, may be directly lodged within cylindrical cavity 60. Thus, the variant of insert 12 shown in FIG. 4 is primarily for use with solid, not tubular, arrow shafts.

Figure 5:
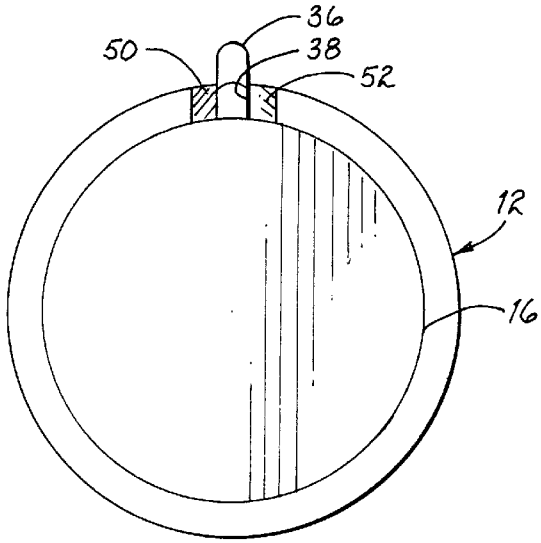
FIG. 5 is an end view from the front of the nock taken along lines 5—5, as shown in FIG. 1.
Figure 6:
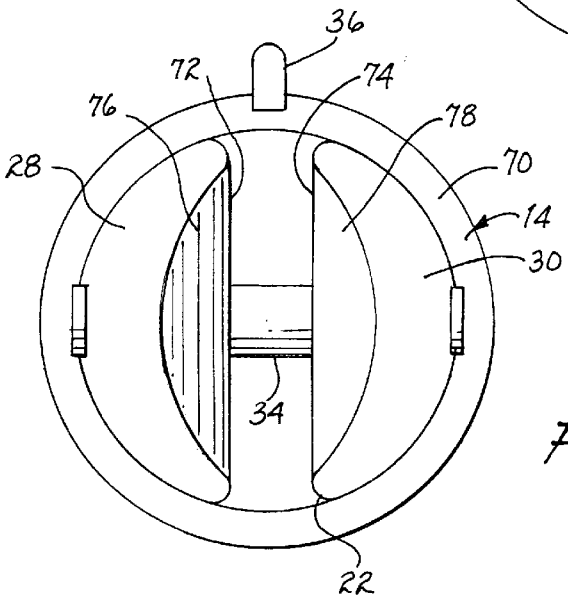
FIG. 6 is an end view from the rear of the nock taken along lines 6—6, as shown in FIG. 1.

Referring jointly to FIGS. 5 and 6, the respective end views of nock 10 will be described. As shown in FIG. 5, stud 16 is of a diameter reduced from that of insert 12 to accommodate for the wall thickness of an hollow arrow shaft disposed thereabout. Thereby, an essentially smooth cylindrical surface is presented at the junction of the arrow shaft and the insert to preclude interfering contact with the bow or elements thereof as the arrow assumes its flight path. Ridge 36, extending radially from the insert, is oriented with respect to the fletchings on the arrow shaft and the bow and its attachments to preclude interference therebetween as the arrow begins its travel past the bow. To prevent any possible interference between ridge 36 and the bow with its attachments, it is to be understood that a ridge may extend radially inwardly from sleeve 24 of receiver 14 for mating with a commensurately formed groove or slot in insert 12.

Receiver 14, as shown in FIG. 6, may include a tapered section 70 to reduce the diameter present at wings 28,30. The inside surfaces of wings 38,30 may include opposed inwardly extending protrusions 72,74 for engaging and being retained at the nocking point on the bowstring. With or without these protrusions the proximal ends of the wings may be outwardly tapered or curved proximally of the protrusions, as depicted by sections 76,78. Forwardly thereof, notch 26 may increase in width and thereafter close in a curved manner. Pin 34 may be flush with the outer surface of the wings or it may protrude slightly from each wing, as illustrated. If one end of the pin protrudes a sufficient length, it may be gripped to remove the pin for insertion of the bowstring into the notch. If the ends of the pin are flush, the pin may be pushed toward one wing and thereafter withdrawn. Insertion of the pin into the wings after the bowstring has been placed in the notch is self-evident.

Figure 7:
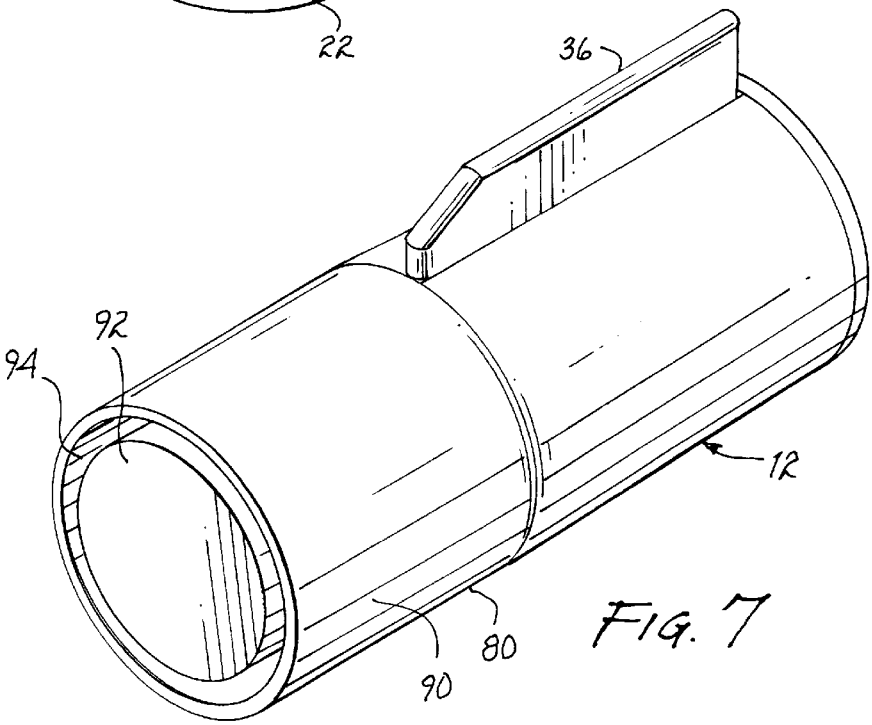
FIG. 7 illustrates a further variant construction of the insert to engage a further type of arrow shaft.

FIG. 7 discloses a variant of insert 12 having a distal end 80 particularly suited for engaging and supporting an hollow arrow shaft. The distal end includes an external cylinder 82 and a stud 84 disposed therewithin to define an annular space 86 equivalent in width to the wall thickness of the arrow shaft. With the construction shown in FIG. 7, a very robust attachment mechanism between the arrow shaft and the insert is achieved. The fit therebetween may be a press fit, an adhesive may be used or other techniques may be used to secure insert 12 to the arrow shaft.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. Archery equipment comprising in combination:

(a) a bow having a bowstring;

(b) an arrow having a shaft, said shaft including a rear end;

(c) a segregable two part nock for disengageably engaging said rear end of said arrow with said bowstring; and (d) said two part nock including an insert attached to said rear end of said arrow, a receiver for engaging said bowstring and for remaining engaged with said bowstring after discharge of said arrow and at least a magnet for disengageably engaging said insert with said receiver.

2. The archery equipment as set forth in claim 1 wherein said magnet includes a pair of magnets.

3. The archery equipment as set forth in claim 1 wherein said magnet is secured to one of said insert and said receiver and including a magnetically responsive member secured to the other of said insert and said receiver.

4. The archery equipment as set forth in claim 3 wherein said receiver includes a cavity for receiving said insert and wherein said magnet and said magnetically responsive member are disposed within said cavity during engagement of said insert with said receiver.

5. The archery equipment as set forth in claim 1 wherein said receiver includes a notch for receiving said bowstring and retention means for retaining said bowstring within said notch during discharge of said arrow to prevent disengagement of said receiver from said bowstring.

6. The archery equipment as set forth in claim 1 wherein said shaft of said arrow is tubular and wherein said insert includes a stud for penetrable engagement with said rear end of said arrow.

7. The archery equipment as set forth in claim 1 wherein said shaft of said arrow is solid and wherein said insert includes a cavity for receiving said rear end of said arrow.

8. Archery equipment comprising in combination:

(a) a bow having a bowstring;

(b) an arrow having a shaft, said shaft including a rear end;

(c) a nock for disengageably engaging said rear end with said bowstring; and (d) said nock including an insert attached to said rear end, a receiver for engaging said bowstring and disconnect means for disengageably engaging said insert with said receiver, said receiver including a notch for receiving said bowstring and a pin extending across said notch for retaining said bowstring within said notch during discharge of said arrow to prevent disengagement of said receiver from said bowstring.

9. A nock for engaging the rear end of an arrow with a bowstring of a bow, said nock comprising in combination:

(a) an insert fixedly attached to the rear end of said arrow;

(b) a receiver for capturing the bowstring and maintaining the bowstring captured during discharge of the arrow from the bow; and (c) at least a magnet for disengageably engaging said insert with said receiver to maintain the arrow engaged with the bowstring prior to discharge of the arrow.

10. The nock as set forth in claim 9 wherein said receiver includes a notch for penetrable engagement by the bowstring and means for retaining the bowstring within said notch during discharge of the arrow from the bow.

11. The nock as set forth in claim 9 wherein said magnet is secured to one of said insert and said receiver and including a magnetically responsive member secured to the other of said insert and said receiver.

12. The nock as set forth in claim 9 wherein said receiver includes a cavity for receiving a part of said insert and for locating said magnet therein during engagement of said insert with said receiver.

13. The nock as set forth in claim 9 wherein said magnet is attached to said receiver and including a further magnet attached to an end of said insert.

14. The nock as set forth in claim 9 wherein the arrow includes a tubular shaft and wherein said insert includes a stud for penetrable engagement with the rear end of the tubular shaft.

15. The nock as set forth in claim 9 wherein said magnet is attached to said receiver and including a magnetically responsive element attached to said insert.

16. The nock as set forth in claim 9 wherein the arrow includes a solid shaft and wherein said insert includes a cavity for receiving the rear end of the solid shaft.

17. The nock as set forth in claim 16 wherein said magnet is attached to one of said receiver and said insert and including an element magnetically responsive to said magnet, said element being attached to the other of said receiver and said insert.

18. A method for disengageably engaging an arrow with the bowstring of a bow and for discharging the arrow from the bow upon release of the drawn bowstring, said method comprising in combination:

(a) attaching an insert to the rear end of the shaft of the arrow;

(b) capturing the bowstring with a receiver having a notch for retaining the bowstring to maintain the receiver in engagement with the bowstring during discharge of the arrow;

(c) maintaining a magnetic force to disengageably engage the insert with the receiver to maintain the arrow attached to the bowstring as the bowstring is drawn back and upon release of the bowstring; and (d) overcoming the magnetic force between the insert and the receiver as a function of the momentum of the arrow when the drawn bowstring comes to its position of rest to release the arrow from the bowstring.

19. The method as set forth in claim 18 wherein said step of maintaining includes the step of magnetically attracting the insert to the receiver when the insert and receiver become engaged with one another upon mounting of the arrow on the bowstring.

20. The method as set forth in claim 18 wherein said step of capturing includes the step of retaining the bowstring within a notch in the receiver.

21. The method as set forth in claim 20 wherein said step of maintaining includes the step of magnetically attracting the insert to the receiver when the insert and receiver become engaged with one another upon mounting of the arrow on the bowstring.

* * * * *

US006213114C1

(12) EX PARTE REEXAMINATION CERTIFICATE (6072nd)

United States Patent
Burkhart

(10) Number: US 6,213,114 C1
(45) Certificate Issued: Jan. 1, 2008

(54) DISENGAGEABLE NOCK FOR ARROWS

(75) Inventor: Christopher I. Burkhart, Phoenix, AZ (US)

(73) Assignee: New Archery Products Corp., Forest Park, IL (US)

Reexamination Request:
No. 90/008,266, Nov. 20, 2006

Reexamination Certificate for:

| | |
|---|---|
| Patent No.: | **6,213,114** |
| Issued: | **Apr. 10, 2001** |
| Appl. No.: | **09/550,677** |
| Filed: | **Apr. 17, 2000** |

(51) Int. Cl.

| | |
|---|---|
| ***F41B 5/14*** | (2006.01) |
| ***F41B 5/18*** | (2006.01) |
| ***F42B 6/06*** | (2006.01) |

(52) U.S. Cl. ..... 124/91
(58) Field of Classification Search ..... None
See application file for complete search history.

(56) References Cited

U.S. PATENT DOCUMENTS

| | | | | |
|---|---|---|---|---|
| 2,796,691 | A | | 6/1957 | Norris |
| 2,926,650 | A | | 3/1960 | Irwin |
| 3,010,446 | A | | 11/1961 | Frantello |
| 3,670,711 | A | | 6/1972 | Firestone |
| 4,027,645 | A | | 6/1977 | Damron |
| 4,109,915 | A | | 8/1978 | Bottelsen |
| 4,146,009 | A | | 3/1979 | Adams |
| 4,290,407 | A | | 9/1981 | Damron |
| 4,706,965 | A | * | 11/1987 | Schaar ..... 473/578 |
| 4,708,341 | A | | 11/1987 | Paraskevakos |
| 4,732,133 | A | | 3/1988 | Chattin |
| 4,829,974 | A | | 5/1989 | Anderson |
| 4,860,719 | A | | 8/1989 | Scheiterlein |
| 4,924,841 | A | | 5/1990 | Smith |
| 4,949,699 | A | | 8/1990 | Gerber |
| 5,081,980 | A | | 1/1992 | Newbold |
| 5,119,797 | A | | 6/1992 | Anderson |
| 5,181,502 | A | | 1/1993 | Ray |
| 5,251,907 | A | | 10/1993 | Ady |
| 5,263,465 | A | | 11/1993 | Anderson |
| 5,361,747 | A | | 11/1994 | Laabs |
| 5,390,654 | A | | 2/1995 | Perkins |
| 5,427,385 | A | | 6/1995 | Conrad et al. |
| 5,465,705 | A | | 11/1995 | Baeseman |
| 5,520,163 | A | | 5/1996 | Hurd |
| 5,553,597 | A | | 9/1996 | Sparks |
| 5,671,723 | A | | 9/1997 | Goff et al. |
| 5,769,065 | A | | 6/1998 | Hurd |
| 6,390,642 | B1 | | 5/2002 | Simonton |
| 6,558,280 | B1 | | 5/2003 | Kuhn |
| 6,679,240 | B1 | | 1/2004 | Hurd |
| 6,764,420 | B2 | | 7/2004 | Cyr et al. |

FOREIGN PATENT DOCUMENTS

| | | |
|---|---|---|
| DE | 3405 463 | 8/1985 |

* cited by examiner

*Primary Examiner*—Jeffrey R. Jastrzab

(57) ABSTRACT

A nock for use with an arrow includes a receiver having a bowstring engaging notch with a pin extending thereacross to capture and retain the bowstring within the notch and an insert permanently attached to an arrow shaft for disengageably engaging the receiver. A retention device, such as a magnet attached to the receiver, magnetically cooperating with a magnetically responsive member attached to the insert, retains the arrow shaft in engagement with the bowstring as the bowstring is pulled back. Upon release of the bowstring, the forward momentum of the arrow overcomes the retention force of the retention device and the arrow shaft disengages from the receiver to begin its flight.

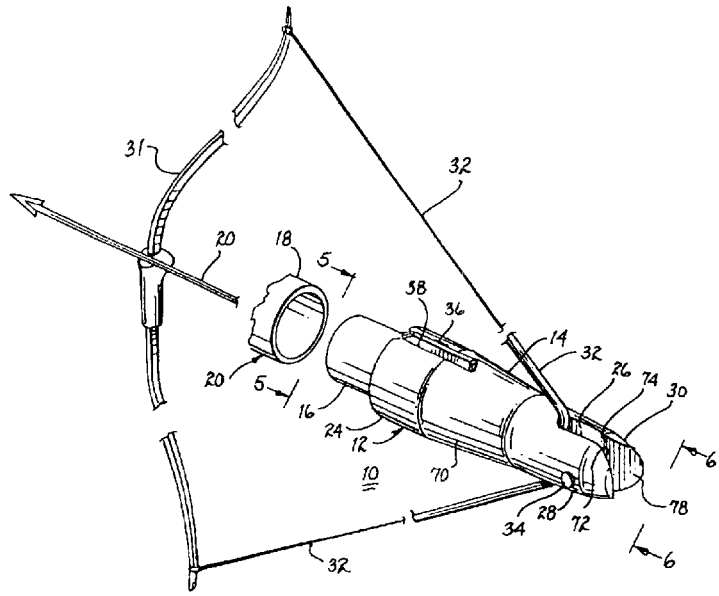

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 4, 8, 12 and 18–21 are cancelled.

Claims 1, 2 and 9 are determined to be patentable as amended.

Claims 5, 6, 7, 10, 11 and 13–17, dependent on an amended claim, are determined to be patentable.

1. Archery equipment comprising in combination:

(a) a bow having a bowstring;

(b) an arrow having a shaft, said shaft including a rear end;

(c) a segregable two part nock for disengageably engaging said rear end of said arrow with said bowstring; and (d) said two part nock including an insert attached to said rear end of said arrow, a receiver for engaging said bowstring and for remaining engaged with said bowstring after discharge of said arrow and at least a magnet for disengageably engaging said insert with said receiver, *wherein said magnet is secured to one of said insert and said receiver and including a magnetically responsive member secured to the other of said insert and said receiver and said receiver includes a cavity for receiving said insert and wherein said magnet and said magnetically responsive member are disposed within said cavity during engagement of said insert with said receiver, and said insert includes a ridge and said receiver includes a slot wherein the ridge extends radially from the insert and is disposed in said slot during engagement of said insert with said receiver*.

2. The archery equipment as set forth in claim 1 wherein said [magnet] *magnetically responsive member* includes a [pair of magnets] *magnet*.

9. A nock for engaging the rear end of an arrow with a bowstring of a bow, said nock comprising in combination:

(a) an insert fixedly attached to the rear end of said arrow;

(b) a receiver for capturing the bowstring and maintaining the bowstring captured during discharge of the arrow from the bow; and (c) at least a magnet for disengageably engaging said insert with said receiver to maintain the arrow engaged with the bowstring prior to discharge of the arrow*;*

*wherein said receiver includes a cavity for receiving a part of said insert and for locating said magnet therein during engagement of said insert with said receiver, and said insert includes a ridge and said receiver includes a slot wherein the ridge extends radially from the insert and is disposed in said slot during engagement of said insert with said receiver*.

* * * * *